US009795991B2

(12) United States Patent
Richter

(10) Patent No.: US 9,795,991 B2
(45) Date of Patent: Oct. 24, 2017

(54) MULTI-LAYER COMPOSITE

(75) Inventor: Gunter Richter, Wuppertal (DE)

(73) Assignee: AXALTA COATING SYSTEMS IP CO., LLC, Wilmington, DE (US)

( * ) Notice: Subject to any disclaimer, the term of this patent is extended or adjusted under 35 U.S.C. 154(b) by 435 days.

(21) Appl. No.: 13/996,695

(22) PCT Filed: Nov. 17, 2011

(86) PCT No.: PCT/US2011/061205
§ 371 (c)(1),
(2), (4) Date: Jun. 21, 2013

(87) PCT Pub. No.: WO2012/091818
PCT Pub. Date: Jul. 5, 2012

(65) Prior Publication Data

US 2013/0276950 A1 Oct. 24, 2013

Related U.S. Application Data

(60) Provisional application No. 61/427,510, filed on Dec. 28, 2010.

(51) Int. Cl.

| | |
|---|---|
| ***B05D 5/06*** | (2006.01) |
| ***B05D 7/04*** | (2006.01) |
| *B05D 7/00* | (2006.01) |

(52) U.S. Cl.
CPC ..... *B05D 5/061* (2013.01); *B05D 7/04* (2013.01); *B05D 7/542* (2013.01); *B05D 5/06* (2013.01); *B05D 7/52* (2013.01); *B05D 2201/04* (2013.01); *B05D 2601/06* (2013.01); *B05D 2601/08* (2013.01); *Y10T 156/10* (2015.01); *Y10T 428/24942* (2015.01)

(58) Field of Classification Search
CPC ..... G02B 5/208; G02B 5/26; B05D 2601/08
USPC ..... 427/160
See application file for complete search history.

(56) References Cited

U.S. PATENT DOCUMENTS

| | | | | |
|---|---|---|---|---|
| 6,818,287 | B1 * | 11/2004 | Ogawa | B32B 27/08 396/452 |
| 2008/0187708 | A1 * | 8/2008 | Decker | B05D 5/061 428/98 |
| 2008/0283171 | A1 | 11/2008 | Nun et al. | |

FOREIGN PATENT DOCUMENTS

| | | | | |
|---|---|---|---|---|
| DE | WO 2009146317 | A1 * | 12/2009 | B05D 3/0254 |
| WO | 2009010521 | A2 | 1/2009 | |
| WO | WO 2009/010521 | A2 * | 1/2009 | C09B 57/00 |
| WO | 2009146317 | A1 | 12/2009 | |
| WO | 2009146318 | A1 | 12/2009 | |
| WO | 2010030970 | A2 | 3/2010 | |
| WO | 2010030971 | A2 | 3/2010 | |

OTHER PUBLICATIONS

ISA European Patent Office, International Search Report and Written Opinion for Application No. PCT/US2011/061205, mailed Mar. 30, 2012.
ISA European Patent Office, International Preliminary Report on Patentability for Application No. PCT/US2011/061205, mailed Jul. 11, 2013.
European Patent Office, Examination Report for Application No. 11 791 705.4, dated Aug. 11, 2015.

* cited by examiner

*Primary Examiner* — Alex A Rolland
(74) *Attorney, Agent, or Firm* — Lorenz & Kopf LLP

(57) ABSTRACT

A process for the production of a multi-layer composite comprising applying a coating layer from a pigmented coating composition A onto the back face of a transparent plastic film and then applying an NIR-opaque coating layer from a pigmented coating composition B, wherein the pigment content of coating composition A consists 50 to 100 wt. % of black pigment with low NIR absorption and 0 to 50 wt. % of further pigment, which is selected in such a way that coating layer A' exhibits low NIR absorption and that the multi-layer composite exhibits a brightness L* of at most 10 units, wherein the pigment content of coating composition B is either a pigment content PC1 consisting 90 to 100 wt. % of aluminum flake pigment and 0 to 10 wt. % of further pigment, which is selected in such a way that NIR-opaque coating layer B' exhibits low NIR absorption, or a pigment content PC2 comprising <90 wt. % of aluminum flake pigments and being composed in such a way that NIR-opaque coating layer B' exhibits low NIR absorption, and wherein coating layers A' and B' are cured.

8 Claims, No Drawings

MULTI-LAYER COMPOSITE

This application is 35 U.S.C. 371 national stage entry from the International Application No. PCT/US11/61205, filed Nov., 17, 2011 which claims priorty benefit from U.S. Provisional Application No. 61/427510, filed on Dec. 28, 2010.

FIELD OF THE INVENTION

The invention is directed to a multi-layer composite comprising a transparent plastic film, the transparent plastic film having a front face and a back face, wherein the back face is provided with a multi-layer coating. The invention is also directed to a process for the production of such multi-layer composite. The invention is furthermore directed to the use of the multi-layer composite, i.e. its application to the surface of a substrate.

DESCRIPTION OF THE PRIOR ART

Dark-color coatings often contain carbon black pigments which absorb radiation in the near-infrared wavelength range and transform it into heat. Substrates coated with paint coatings of this type heat up in the NIR-containing sunlight; this occurs via heat conduction, i.e., heat is directly transferred to the substrate from the coating layer containing carbon black pigments and heated by solar radiation. This type of heating is often undesirable; for example, it may be undesirable for the actual substrate material itself and/or for the interior of the substrate to be heated up.

WO 2009/146317 A1, WO 2009/146318 A1, WO 2010/030970 A2 and WO 2010/030971 A2 disclose processes for the production of a multi-layer coating on a substrate, during which a substrate is provided with an NIR-opaque coating layer exhibiting low NIR absorption and subsequently with a dark-color coating layer exhibiting low NIR absorption. The substrates so provided with dark-color multi-layer coatings heat up only comparatively slightly in sunlight.

SUMMARY OF THE INVENTION

The invention is directed to a multi-layer composite in the form of a transparent plastic film which has a multi-layer coating on its back face. The multi-layer composite can be produced by a process comprising the successive steps:

(1) applying a coating layer A' from a pigmented coating composition A onto the back face of a transparent plastic film, and (2) applying an NIR-opaque coating layer B' from a pigmented coating composition B onto the coating layer A', wherein the pigment content of coating composition A consists 50 to 100 wt. % (weight-%) of at least one black pigment with low NIR absorption and 0 to 50 wt. % of at least one further pigment, which is selected in such a way that coating layer A' exhibits low NIR absorption and that the multi-layer composite exhibits a brightness L* of at most 10 units, wherein the pigment content of coating composition B is either a pigment content PC1 consisting 90 to 100 wt. % of at least one aluminum flake pigment and 0 to 10 wt. % of at least one further pigment, which is selected in such a way that NIR-opaque coating layer B' exhibits low NIR absorption, or a pigment content PC2 comprising <90 wt. % of aluminum flake pigments and being composed in such a way that NIR-opaque coating layer B' exhibits low NIR absorption, and wherein coating layers A' and B' are cured.

The invention is therefore also directed to the process for the production of the multi-layer composite.

DETAILED DESCRIPTION OF THE EMBODIMENTS

The abbreviation "NIR" used herein stands for "near infrared" or "near infrared radiation" and shall mean infrared radiation in the wavelength range of 780 to 2100 nm.

The term "NIR-opaque coating layer" is used herein. It refers to a dried or cured pigmented coating layer with a film thickness at least as thick that underlying substrate surfaces (substrate surfaces located directly beneath the coating layer) with different NIR absorption are no longer discernible by NIR reflection measurement (no longer distinguishable from each other by NIR reflection measurement), i.e., at or above this minimum dry film thickness no difference can be determined when measuring the NIR reflection of the coating layer applied to such different substrate surfaces and dried or cured; or to put it into other words, the NIR reflection curve measured is then only determined by the NIR-opaque coating layer. In still other words, an NIR-opaque coating layer is characterized in that its dry film thickness corresponds to or exceeds said minimum film thickness, but may not fall below it. It goes without saying that this minimum film thickness depends on the pigmentation of the respective coating layer, i.e., it depends on the composition of the pigment content as well as on the pigment/resin solids weight ratio. In order to determine said minimum film thickness, the respective coating composition may be applied in a wedge shape onto a black and white chart and dried or cured. Black and white charts are typically used when determining black/white opacity of coating compositions (see, for example, ISO 6504-3:2006 (E), method B). NIR reflection measurement is known to the person skilled in the art and can be carried out making use of a conventional NIR spectrophotometer (measuring geometry 8°/d), for example, the instrument Lambda 19 sold by the firm Perkin-Elmer. NIR-opacity of an NIR-opaque coating layer can be the result of NIR absorption and/or NIR reflection and/or NIR scattering.

In the description and the claims "cured" or "curing" is used in the context of curing of coatings. To avoid misunderstandings, said use of "cured" or "curing" shall not be interpreted to mean only "chemically crosslinked" or "chemically crosslinking". Rather, it may also mean "physically dried" or "physically drying".

The term "film thickness" is used herein. It refers always to the dry film thickness of the respective dried or cured coating. Accordingly, any film thickness values indicated in the description and in the claims for coating layers refer in each case to dry film thicknesses.

The term "pigment content" is used herein. It means the sum of all the pigments contained in a coating composition without fillers (extenders, extender pigments). The term "pigments" is used here as in DIN 55944 and covers, in addition to special effect pigments, inorganic white, colored and black pigments and organic colored and black pigments. At the same time, therefore, DIN 55944 distinguishes between pigments and fillers.

The term "resin solids" is used herein. The resin solids of a coating composition consist of the solids contribution of the coating binders (binder solids) and the solids contribution of crosslinkers (crosslinker solids) optionally contained in the coating composition.

The term "black/white opacity" is used herein. It refers to the dry film thickness of a pigmented coating composition wherein the contrast between the black and white fields of a black and white chart coated with the coating composition is no longer visually discernible (mean film thickness value determined on the basis of evaluation by 5 independent individuals). It goes without saying that this film thickness depends on the pigmentation of the respective coating layer, i.e., it depends on the composition of the pigment content as well as on the pigment/resin solids weight ratio. Following ISO 6504-3:2006 (E), method B, in order to determine said film thickness, the pigmented coating composition of which the black/white opacity is to be investigated may be applied in a wedge shape onto a black and white chart and dried or cured.

The term "coating layer A' exhibiting low NIR absorption" is used herein. It shall mean a coating layer A' which would exhibit an NIR reflection of at least 33% over the entire NIR wavelength range of 780 to 2100 nm, if it were applied and dried or cured on an NIR-opaque coating layer pigmented exclusively with aluminum flake pigment. The person skilled in the art may, for example, produce test panels provided with a dried or cured coating layer applied from a coating composition pigmented exclusively with aluminum flake pigment, and may use said test panels as test substrates for coating with coating compositions to be tested for their NIR absorption. Once the coating layer applied from the coating composition to be tested has dried or cured, the NIR reflection of said coating layer can be measured. The NIR reflection measurement itself can be carried out as explained above. The method mentioned in this paragraph can be used by the skilled person when developing the pigmentation of a coating composition A.

The term "coating layer B' exhibiting low NIR absorption" is used herein. In the embodiment, where coating layer B' is applied from a coating composition B having a pigment content PC1, it shall mean an NIR-opaque coating layer B' which exhibits an NIR reflection of at least 48% over the entire NIR wavelength range of 780 to 2100 nm, i.e., at any wavelength within this NIR wavelength range. In the other embodiment of a coating layer B' applied from a coating composition B having a pigment content PC2, it shall mean an NIR-opaque coating layer B' which exhibits an NIR reflection of at least 48% over the entire NIR wavelength range of 780 to 1600 nm and an NIR reflection of at least 30% over the entire NIR wavelength range of above 1600 to 2100 nm. The NIR reflection measurement can be carried out as explained above.

The term "aluminum flake pigments" is used herein. It means aluminum pigments, in particular those of the non-leafing type, as are conventionally used as special effect pigments in paint and coatings to provide a metallic effect, i.e., a brightness flop dependent on the angle of observation. Generally, such aluminum flake pigments are 100 to 1000 nm thick and have a mean particle diameter of, for example, 5 to 50 μm, preferably 5 to 35 μm. The mean particle diameters may be inferred, for example, from the technical documents of manufacturers of such aluminum flake pigments. Examples of such commercially available aluminum flake pigments include those sold by Eckart under the names "STAPA Hydrolac®", "STAPA Hydrolux®" and "STAPA IL Hydrolan®". However, aluminum flake pigments with a thinner flake thickness of 10 to 80 nm, preferably 20 to 80 nm, are also meant by the term "aluminum flake pigments" used herein. The 10 to 80 nm thick aluminum flake pigments have an aspect ratio (the ratio of the flake diameter to the flake thickness) that is very high. The 10 to 80 nm thick aluminum flake pigments are produced, for example, by vacuum deposition or ultrathin grinding of special aluminum grits. Generally such thin aluminum flake pigments have a mean particle diameter of, for example, 5 to 30 μm, preferably 5 to 20 μm. The mean particle diameters may be inferred, for example, from the technical documents of manufacturers of such thin aluminum flake pigments. Examples of such thin commercially available aluminum flake pigments include those sold under the names Metalure®, Silvershine® and Hydroshine®, in each case by Eckart, Metasheen® by Ciba, Starbrite® by Silberline and Decomet® by Schlenk.

The term "mean particle diameter" (average particle size) is used herein. It refers to d50 values determined by laser diffraction (50% of the particles have a particle diameter above and 50% of the particles have a particle diameter below the mean particle diameter).

The term "brightness L*" is used herein. It means the brightness L* (according to CIEL*a*b*, DIN 6174), measured on the front face of the multi-layer composite at an illumination angle of 45 degrees to the perpendicular (surface normal) and an observation angle of 45 degrees to the specular (specular reflection). Said brightness L* measurement is known to the person skilled in the art and can be carried out with commercial professional measuring instruments, for example, the instrument X-Rite MA 68 sold by the firm X-Rite Incorporated, Grandeville, Mich., USA.

The term "front face" is used herein. The front face of the transparent plastic film or of the multi-layer composite is the side which is turned towards an observer, whereas the back face of the transparent plastic film is the side which carries the multi-layer coating comprising the coating layer A' adjacent to the back face and the coating layer B' on top of coating layer A'. In other words, the multi-layer composite of the present invention comprises the structure "transparent plastic film/coating layer A'/coating layer B'", wherein coating layer A' can be visually perceived when looking at the front face of the multi-layer composite (when looking through the transparent plastic film).

In step (1) of the process of the present invention the back face of a transparent plastic film is provided with a coating layer A'. The transparent plastic film is a colorless film from any desired plastics, in particular thermoplastics or composite films of two or more plies of one or more different thermoplastics. Suitable transparent plastic film materials are, for example, polyolefins, such as, polyethylene, polypropylene; polyvinyl chloride; polyurethane; polyamide and polyesters, such as, polyethylene terephthalate and polybutylene terephthalate. The transparent plastic film may also consist of a polymer blend. The thickness of the transparent plastic film may, for example, be between 30 and 1000 μm.

The coating layer A' is applied from a pigmented coating composition A.

Coating composition A may be a coating composition comprising no liquid carrier like water and/or organic solvents. However, typically, coating composition A is a solvent- or waterborne coating composition in which case it contains (i) one or more organic solvents or (ii) water or (iii) water and one or more organic solvents.

In addition to its pigment content and, in case coating composition A is a solvent- or waterborne coating composition, water and/or organic solvent(s), coating composition A comprises a resin solids content and the following optional components: fillers and conventional coating additives.

The resin solids of coating composition A comprise one or more conventional coating binders known to the person skilled in the art. Examples include polyester, polyurethane and (meth)acrylic copolymer resins and also hybrid binders derived from these resin classes. Furthermore the resin solids may comprise one or more crosslinkers and one or more paste resins (grinding resins; resins used for pigment grinding) or polymeric pigment wetting or dispersion aids. If paste resins or polymeric pigment wetting or dispersion aids are comprised they are counted as binders.

Coating composition A comprises a pigment content consisting 50 to 100 wt. % of at least one black pigment with low NIR absorption and 0 to 50 wt. % of at least one further pigment which is selected in such a way that coating layer A' exhibits low NIR absorption and that the multi-layer composite of the present invention exhibits a brightness L* of at most 10 units, wherein the sum of the wt. % equals 100 wt. %. The pigment/resin solids ratio by weight of coating composition A is, for example, 0.1:1 to 1:1.

A black pigment with low NIR absorption is one which, when pigmenting a coating composition with said black pigment and an aluminum flake pigment in a pigment weight ratio of 10:90 and without using other pigments, results in the NIR reflection of a dried or cured coating layer applied from the coating composition in an NIR-opaque film thickness being at least 33% over the entire wavelength range of 780 to 2100 nm. The NIR reflection can be measured as explained above for the measurement of the NIR reflection of an NIR-opaque coating layer. Preferred examples of black pigments with low NIR absorption are iron oxide black pigments, mixed metal/iron oxide black pigments, for example, of the inverse spinel type, and, in particular, perylene black pigments. Examples of commercially available perylene black pigments are Paliogen® Black L 0084 and Paliogen® Black L 0086 from BASF.

The pigment content of coating composition A may consist exclusively of the at least one black pigment with low NIR absorption or it may also comprise above 0 to 50 wt. % of at least one further pigment which is selected in such a way that coating layer A' exhibits low NIR absorption and that the multi-layer composite of the present invention exhibits a brightness L* of at most 10 units. In other words, the selection of the at least one further pigment is performed in a manner meeting two conditions, namely condition (i) relating to the low NIR absorption of coating layer A' and, simultaneously, condition (ii) relating to the brightness L* of the multi-layer composite of at most 10 units.

This means with regard to condition (i): In case there is only one single further pigment its wt. % proportion is selected within said range of above 0 to 50 wt. % such that coating layer A' exhibits low NIR absorption; if the one single further pigment is a pigment with strong NIR absorption, the skilled person will select its wt. % proportion more at the lower end of said wt. % range, whereas in case of one single further pigment with low NIR absorption the opposite is possible. In case there is a combination of two or more further pigments with different NIR absorption power the same principles apply and the proportion of each of the further pigments may accordingly be selected within the range of above 0 to 50 wt. %, i.e., taking into account the NIR absorption of each individual further pigment. The person skilled in the art knows how to determine the NIR absorption or NIR absorption power of a pigment. The NIR absorption of a pigment may easily be determined, for example, by pigmenting a coating composition with the pigment in question and aluminum flake pigment in a pigment weight ratio of 10:90, i.e., without using other pigments, by applying and drying or curing the coating composition thus pigmented in an NIR-opaque film thickness, and by measuring the NIR reflection of the resultant coating layer over the entire wavelength range of 780 to 2100 nm. The NIR reflection can be measured as explained above for the measurement of the NIR reflection of an NIR-opaque coating layer.

At the same time this means with regard to condition (ii): In case there is only one single further pigment its wt. % proportion is selected within said range of above 0 to 50 wt. % such that the multi-layer composite exhibits a brightness L* of at most 10 units; if the one single further pigment has a light color, the skilled person will not select its wt. % proportion at the upper end of said wt. % range, whereas in case of one single further pigment with a dark color this may be possible. In case there is a combination of two or more further pigments with not only different color but also different brightness the same principles apply and the proportion of each of the further pigments may accordingly be selected within the range of above 0 to 50 wt. %, i.e., taking into account the brightness of each individual further pigment.

The further pigment(s) that may optionally be contained in coating composition A, in addition to the at least one black pigment with low NIR absorption may, for example, be special effect pigments and/or pigments selected from white, colored and other black pigments (black pigments different from the black pigments with low NIR absorption).

Examples of such special effect pigments which may be used in coating composition A include conventional pigments imparting to a coating a color and/or brightness flop dependent on the angle of observation, such as non-leafing metal pigments, for example, aluminum flake pigments or flake pigments of metals other than aluminum, interference pigments such as, for example, metal oxide-coated metal pigments, for example, iron oxide-coated aluminum, coated mica such as, for example, titanium dioxide-coated mica, iron oxide in flake form, liquid crystal pigments, coated aluminum oxide pigments, and coated silicon dioxide pigments.

Examples of such white, colored and other black pigments which may be used in coating composition A are conventional inorganic or organic pigments known to the person skilled in the art, such as, for example, titanium dioxide, carbon black, iron oxide pigments different from iron oxide black pigments, azo pigments, phthalocyanine pigments, quinacridone pigments, pyrrolopyrrole pigments, and perylene pigments different from perylene black pigments.

It is preferred that coating composition A does not contain any carbon black.

The black pigment(s) with low NIR absorption and the further pigments that may optionally be contained in coating composition A are generally ground with the exception of possible special effect pigments. Grinding is generally performed until at least 70% of the maximum tinting strength achievable in the non-volatile system of coating composition A is achieved (non-volatile system of coating composition A means resin solids of coating composition A plus non-volatile additives of coating composition A). The determination of the maximum tinting strength is known to the person skilled in the art (compare, for example, DIN 53238). The grinding may be performed in conventional assemblies known to the person skilled in the art. Generally, the grinding takes place in a proportion of the binder or in specific paste resins. The formulation is then completed with the remaining proportion of the binder or of the paste resin.

The possible special effect pigments are not ground. They are typically initially introduced in the form of a commercially available paste, optionally combined with organic solvents and, optionally, polymeric pigment wetting or dispersion aids and/or other additives, and then mixed with the binder(s). Special effect pigments in powder form may first be processed with organic solvents and, optionally, polymeric pigment wetting or dispersion aids and/or other additives to yield a paste.

Coating composition A may also contain one or more fillers, for example, in a total proportion of up to 20 wt. % based on the resin solids. For the fillers the same principles apply as are valid for the at least one further pigment, i.e., if fillers are contained in coating composition A they are selected in such a way that coating layer A' exhibits low NIR absorption. The fillers may have a mean particle diameter of, for example, 20 nm to 3 μm. The fillers do not constitute part of the pigment content of coating composition A. Examples are barium sulfate, kaolin, talcum, silicon dioxide, layered silicates and any mixtures thereof.

Coating composition A may contain conventional additives in a total quantity of, for example, 0.1 to 5 wt. %, relative to its solids content. Examples are neutralizing agents, antifoaming agents, wetting agents, adhesion promoters, catalysts, leveling agents, anticratering agents, thickeners and light stabilizers, for example, UV absorbers and/or HALS compounds (HALS, hindered amine light stabilizers).

If coating composition A is a waterborne coating composition, it comprises water in a proportion of, for example, 55 to 90 wt. % and, optionally, also one or more organic solvents in a proportion of, for example, 0 to 20 wt. %. If it is a solventborne coating composition, it does not comprise water but one or more organic solvents in a proportion of, for example, 55 to 90 wt. %.

Examples of organic solvents which can be used in coating composition A include alcohols, for example, propanol, butanol, hexanol; glycol ethers, for example, diethylene glycol di-C1-C6-alkyl ether, dipropylene glycol di-C1-C6-alkyl ether, ethoxypropanol, ethylene glycol monobutyl ether; glycol esters, for example, ethylene glycol monobutyl ether acetate; esters, for example, butyl acetate, amyl acetate; glycols, for example, ethylene glycol and/or propylene glycol, and the di- or trimers thereof; N-alkylpyrrolidone, for example, N-ethylpyrrolidone; ketones, for example, methyl ethyl ketone, acetone, cyclohexanone; aromatic or aliphatic hydrocarbons, for example, toluene, xylene or linear or branched aliphatic C6-C12 hydrocarbons.

The overall solids content of a solvent- or waterborne coating composition A is in the range of 10 to 40 wt. %, based on the total composition. Accordingly, the proportion of volatiles (volatile materials) is 60 to 90 wt. %. The volatiles comprise the aqueous or non-aqueous carrier and possible volatile additives. An aqueous carrier comprises water and possible organic solvents, whereas a non-aqueous carrier comprises only organic solvents.

In step (2) of the process of the present invention an NIR-opaque coating layer B' is applied onto coating layer A'.

The NIR-opaque coating layer B' is applied from a pigmented coating composition B.

Coating composition B may be a coating composition comprising no liquid carrier like water and/or organic solvents. However, typically, coating composition B is a solvent- or waterborne coating composition in which case it contains (i) one or more organic solvents or (ii) water or (iii) water and one or more organic solvents.

In addition to its pigment content and, in case coating composition B is a solvent- or waterborne coating composition, water and/or organic solvent(s), coating composition B comprises a resin solids content and the following optional components: fillers and conventional coating additives.

The resin solids of coating composition B comprise one or more conventional coating binders known to the person skilled in the art. Examples include polyester, polyurethane and (meth)acrylic copolymer resins and also hybrid binders derived from these resin classes. Furthermore the resin solids may comprise one or more crosslinkers and one or more paste resins or polymeric pigment wetting or dispersion aids. If paste resins or polymeric pigment wetting or dispersion aids are comprised they are counted as binders.

Coating composition B contains one or more pigments. As already mentioned, two different types of pigment content are possible for coating composition B, namely a pigment content of the PC1 or the PC2 type.

In the embodiment of a pigment content PC1, the pigment/resin solids ratio by weight of coating composition B is, for example, 0.05:1 to 50:1, preferably 0.05:1 to 1:1 or 0.1:1 to 1:1.

In the other embodiment of a pigment content PC2, the pigment/resin solids ratio by weight of coating composition B is, for example, 0.1:1 to 2:1.

Pigment content PC1 consists 90 to 100 wt. % of at least one aluminum flake pigment and 0 to 10 wt. % of at least one further pigment, which is selected in such a way that NIR-opaque coating layer B' exhibits low NIR absorption, and wherein the sum of the wt. % equals 100 wt. %.

It is preferred that pigment content PC1 consists exclusively of the at least one aluminum flake pigment. However, it may also comprise above 0 to 10 wt. % of at least one further pigment which is selected in such a way that NIR-opaque coating layer B' exhibits low NIR absorption. This means that, in case there is only one single further pigment, its wt. % proportion is selected within said range of above 0 to 10 wt. % such that NIR-opaque coating layer B' exhibits low NIR absorption; if the one single further pigment is a pigment with strong NIR absorption, the skilled person will select its wt. % proportion more at the lower end of said range of above 0 to 10 wt. %, whereas in case of one single further pigment with low NIR absorption the opposite is possible. In case there is a combination of two or more further pigments with different NIR absorption power the same principles apply and the proportion of each of the further pigments may accordingly be selected within the range of above 0 to 10 wt. %, i.e., taking into account the NIR absorption of each individual further pigment.

Pigment content PC2 comprises <90 wt. % of aluminum flake pigments and is composed in such a way that NIR-opaque coating layer B' exhibits low NIR absorption. This means that, in case pigment content PC2 comprises only one single pigment, the latter is selected in such a way that NIR-opaque coating layer B' exhibits low NIR absorption. In case there is a combination of two or more pigments with different NIR absorption power the proportion of each of the pigments is selected taking into account the NIR absorption of each individual pigment.

As already mentioned before, the person skilled in the art knows how to determine the NIR absorption or NIR absorption power of a pigment.

The further pigment(s) that may be contained in pigment content PC1, in addition to the at least one aluminum flake pigment, may, for example, be other special effect pigments and/or pigments selected from white, colored and black pigments.

The pigment(s) making up pigment content PC2 may be special effect pigments and/or pigments selected from white, colored and black pigments provided that pigment content PC2 comprises <90 wt. % of aluminum flake pigments and is composed in such a way that NIR-opaque coating layer B' exhibits low NIR absorption.

Examples of special effect pigments that can be contained in pigment content PC1, in addition to aluminum flake pigment(s), include conventional pigments imparting to a coating a color and/or brightness flop dependent on the angle of observation, such as, flake pigments of metals other than aluminum, interference pigments such as, for example, metal oxide-coated metal pigments, for example, iron oxide-coated aluminum, coated mica such as, for example, titanium dioxide-coated mica, iron oxide in flake form, liquid crystal pigments, coated aluminum oxide pigments, and coated silicon dioxide pigments.

Examples of special effect pigments that can be contained in pigment content PC2 include aluminum flake pigments and those mentioned in the preceding paragraph.

Examples of white, colored and black pigments that can be contained in pigment content PC1 and in pigment content PC2 are conventional inorganic or organic pigments known to the person skilled in the art, such as, for example, titanium dioxide, carbon black, iron oxide pigments, azo pigments, phthalocyanine pigments, quinacridone pigments, pyrrolopyrrole pigments, and perylene pigments.

In an embodiment, pigment content PC2 comprises less than 25 wt. % of aluminum flake pigments, in particular, no aluminum flake pigment.

In another embodiment, pigment content PC2 is free of special effect pigments, coating composition B then being a solid color (single-tone color) coating composition.

In still another embodiment, pigment content PC2 comprises 80 to 100 wt. %, in particular 90 to 100 wt. % of titanium dioxide.

It is preferred that pigment content PC1 and pigment content PC2 do not contain any carbon black, or, in other words, it is preferred that coating composition B does not contain any carbon black.

With the exception of special effect pigments, the pigments that are contained in the pigment content of coating composition B are generally ground. Grinding is generally performed until at least 70% of the maximum tinting strength achievable in the non-volatile system of coating composition B is achieved (non-volatile system of coating composition B means resin solids of coating composition B plus non-volatile additives of coating composition B). The grinding may be performed in conventional assemblies known to the person skilled in the art. Generally, the grinding takes place in a proportion of the binder or in a paste resin. The formulation is then completed with the remaining proportion of the binder or of the paste resin.

Special effect pigments are not ground, but are typically initially introduced in the form of a commercially available paste, optionally, combined with organic solvents and, optionally, polymeric pigment wetting or dispersion aids and/or other additives, and then mixed with the binder(s). Special effect pigments in powder form may first be processed with organic solvents and, optionally, polymeric pigment wetting or dispersion aids and/or other additives to yield a paste.

Coating composition B may also contain one or more fillers. For the fillers the same principles apply as are valid for the at least one further pigment, i.e., if fillers are contained in coating composition B, they are selected in such a way that NIR-opaque coating layer B' exhibits low NIR absorption. The fillers may have a mean particle diameter of, for example, 20 nm to 3 μm. The fillers do not constitute part of the pigment content of coating composition B. Examples are barium sulfate, kaolin, talcum, silicon dioxide, layered silicates and any mixtures thereof.

Coating composition B may contain conventional additives in a total quantity of, for example, 0.1 to 5 wt. %, relative to its solids content. Examples are neutralizing agents, antifoaming agents, wetting agents, adhesion promoters, catalysts, leveling agents, anticratering agents, thickeners and light stabilizers, for example, UV absorbers and/or HALS compounds.

If coating composition B is a waterborne coating composition, it comprises water in a proportion of, for example, 55 to 98 wt. %, or in an embodiment, 55 to 90 wt. %; optionally, one or more organic solvents may also be contained in a total proportion of, for example, 0 to 20 wt. %. If coating composition B is a solventborne coating composition, it does not comprise water but one or more organic solvents in a proportion of, for example, 55 to 98 wt. %, or in an embodiment, 55 to 90 wt. %.

Examples of organic solvents which can be used in coating composition B are the same that have been previously mentioned as examples of organic solvents in connection with coating composition A.

The overall solids content of a solvent- or waterborne coating composition B is in the range of 2 to 40 wt. %, or in an embodiment, 10 to 40 wt. %, based on the total composition. Accordingly, the proportion of volatiles is 60 to 98 wt. %, or in an embodiment, 60 to 90 wt. %. The volatiles comprise the aqueous or non-aqueous carrier and possible volatile additives. The aqueous carrier comprises water and the possible organic solvents whereas the non-aqueous carrier comprises only organic solvents.

The process of the present invention comprises the successive steps (1) and (2). The coating layers A' and B' applied in the course of that process are cured. Curing of coating layers A' and B' may be performed at various points of time as will become apparent from the following.

In step (1) of the process of the present invention coating composition A is applied onto the back face of the transparent plastic film. Application of coating composition A may be performed by various application methods, for example, printing, spray coating or, in particular, roller coating.

Coating composition A may be applied in a relatively thin film thickness to form a transparent or semitransparent coating layer A'; generally, the film thickness of a (semi) transparent coating layer A' is in the range of, for example, 4 to 20 μm. It is preferred however, that coating composition A is applied sufficiently thick so as to form a visually opaque coating layer A'; then its film thickness corresponds to or exceeds black/white opacity. The dry film thickness of a visually opaque coating layer A' is higher than that of a (semi)transparent coating layer A' and lies generally in the range of, for example, 8 to 30 μm.

As already mentioned, coating layer A' may be (semi) transparent, and in this case the color of the multi-layer composite is determined by the color contributions of both coating layers A' and B', although in general coating layer A' makes the main contribution to the color of the multi-layer composite. If coating layer A' is a visually opaque coating layer, it is the coating layer which determines the color of the multi-layer composite. The transparent plastic film forms the final outer layer of the multi-layer composite. Generally the transparent plastic film does not or essentially not contribute to the color of the multi-layer composite.

Prior to application of coating composition B coating layer A' may optionally be cured. Curing may be performed by application of heat, for example, exposing the transparent plastic film provided with coating layer A' to conditions which enable an object peak temperature in the range of, for example, 60 to 250° C.

In step (2) of the process of the present invention coating composition B is applied in a film thickness so as to form an NIR-opaque coating layer B' exhibiting low NIR absorption. Generally the film thickness of coating layer B' will then also correspond to at least black/white opacity or be even higher. Not least for cost reasons NIR-opaque coating layer B' is not applied unnecessarily thick. The film thickness of a coating layer B' applied from a coating composition B having a pigment content PC1 is in the range of, for example, 2 to 30 μm, or in an embodiment, 4 to 20 μm. The film thickness of a coating layer B' applied from a coating composition B having a pigment content PC2 is in the range of, for example, 7 to 45 μm, or in an embodiment, 9 to 35 μm.

Application of coating composition B may be performed by various application methods, for example, printing, spray coating or, in particular, roller coating.

Curing of coating layer B' may be performed by application of heat, for example, exposing the transparent plastic film provided with coating layer A' and coating layer B' to conditions which enable an object peak temperature in the range of, for example, 60 to 250° C.

Coating layers A' and B' may be applied by the so-called wet-on-wet application method, i.e., coating composition B is then applied onto the not yet cured coating layer A' and both coating layers are thereafter jointly cured. This joint curing may be performed by application of heat, for example, exposing the transparent plastic film provided with the in each case uncured coating layers A' and B' to conditions which enable an object peak temperature in the range of, for example, 60 to 250° C.

The multi-layer composite produced by the process of the present invention exhibits a dark color in terms of that it exhibits a brightness L* of at most 10 units. Examples of such dark colors are corresponding dark-green, dark-blue, dark-red, dark-brown, dark-grey and black color shades and they include solid colors and special effect colors like metallic and/or mica color shades.

The multi-layer composite can be provided with one or more additional layers applied onto coating layer B'. Examples of such additional layers are coating layers and plastic films.

The multi-layer composite with its front face turned towards the sun heats up only comparatively slightly. The multi-layer composite can therefore be used to provide substrate surfaces with a dark-color covering which heats up only comparatively slightly in sunlight.

The multi-layer composite can be applied to surfaces of various substrates, wherein the substrates may be comprised of one or various materials including, for example, metals and plastics. The substrates may already be provided with a coating or they may be uncoated. Examples of substrates include vehicles including automotive vehicles; housings of apparatuses; buildings and parts thereof including roofs, roof parts, facades and facade elements.

Once applied to a substrate surface the multi-layer composite has several functions including a decorative and a protective function. It provides the substrate with a dark-color surface, with mechanical protection and with protection against influence of the environment including heat protection in terms of preventing strong heating-up in sunlight.

Application of the multi-layer composite is performed with the back face turned towards the substrate surface so that the uncoated front face of the multi-layer composite is turned towards an observer who can perceive coating layer A' through the outer transparent plastic film.

The multi-layer composite can be applied in the form of a set, i.e. it may be used in the form of a number of multi-layer composite pieces cut to fit individual surfaces of a substrate.

Application of the multi-layer composite may be performed by laminating or adhesive bonding, for example. Laminating or adhesive bonding may optionally be promoted by suitable measures, for example, the action of heat and/or vacuum. Adhesive bonding may be achieved by using a hot-melt adhesive, an aqueous dispersion adhesive or a solvent-based adhesive or the multi-layer composite is self-adhesive by means of a pressure sensitive adhesive on its back face.

In an embodiment, the substrate onto which surface the multi-layer composite is applied is a plastic substrate formed by per se known injection molding or reaction-injection molding (RIM). In said embodiment, the application of the multi-layer composite to the surface of a plastic substrate is performed involving said per se known injection molding or reaction-injection molding process. In the course of such molding process the plastic substrate to be covered is not only formed but at the same time covered with the multi-layer composite. Such process comprises putting the multi-layer composite into a mold, for example, a thermoforming mold, injecting a liquid polymeric material into the mold and letting the polymeric material solidify to form the plastic substrate. The plastic substrate may be hollow or not, or it may be a foamed article. The liquid polymeric material can be a thermoplastic material or a liquid mixture of reactive components. During said (reaction-) injection molding process the so-formed plastic substrate and the multi-layer composite are firmly joint with the surface of the plastic substrate adjacent to the back face of the multi-layer composite, i.e., with the surface of the plastic substrate adjacent to the coating layer B' or to optionally present further layer(s) applied onto coating layer B'. After solidification of the polymeric material the mold can be opened and the plastic substrate covered with the dark-color multi-layer composite can be released.

EXAMPLES

Unless otherwise noted, all components of the following examples are believed to be available from the Aldrich Chemical Company, Milwaukee, Wis. The following other components were used in the examples.

CYMEL® 303 melamine and DAOTAN® VTW 1236 aqueous aliphatic polyurethane dispersion are available from Cytec Industries, West Patterson, N.J.

SOLSPERSE® 20000 dispersant is available from the Lubrizol Corporation, Wickliffe, Ohio.

SURFYNOL® 104 nonionic surfactant is available from Air Products and Chemicals, Inc., Allentown, Pa.

PALIOGENBLACK® BLACK L 0086 pigment is available from BASF, Germany.

CARBON BLACK FW 200® pigment is available from Evonik Industries, Essen, Germany.

LAPONITE® RD sheet silicate is available from Southern Clay Products, Gonzales, Tex.

ACRYSOL® ASE 60 anionic thickener is available from Rohm and Haas (now part of the Dow Chemical Company, Midland Mich.), Philadelphia, Pa.

TI-PURE® R-706 titanium dioxide pigment is available from DuPont.

STAPA®HYDROLAN 9160 metal effect pigment is available from Altana/Eckart, Fürth, Germany.

Preparation of a Carbon Black Pigment Dispersion:

The following pigment slurry was prepared with 33.4 g (grams) of de-ionized water, 9.4 g of a 30% non-volatile hydroxy functional aqueous acrylic microgel, 18.8 g butoxyethanol, 14.1 g CYMEL® 303, 4.7 g SOLSPERSE® 20000 and 6.6 g of 10% aqueous dimethylethanol amine solution and 0.5 g SURFYNOL® 104. The above components were mixed together, 12.5 g of CARBON BLACK FW 200® pigment was added and the resulting slurry was pre-dispersed using a Cowles blade. The mixture was then ground in a horizontal beadmill until the desired particle size of less than 0.5 micron was achieved.

Preparation of a Perylene Black Pigment Dispersion:

The following pigment slurry was prepared with 27.5 g of de-ionized water, 7.7 g of a 30% non-volatile hydroxy functional aqueous acrylic microgel, 15.5 g butoxyethanol, 11.6 g CYMEL® 303, 3.9 g SOLSPERSE® 20000 and 5.4 g of 10% aqueous dimethylethanol amine solution and 0.4 g SURFYNOL® 104. The above components were mixed together, 28.0 g of PALIOGENBLACK® BLACK L 0086 pigment was added and the resulting slurry was pre-dispersed using a Cowles blade. The mixture was then ground in a horizontal beadmill until the desired particle size of less than 0.5 micron was achieved.

Preparation of a Titanium Dioxide Pigment Dispersion:

The following pigment slurry was prepared with 9.1 g of de-ionized water, 7.2 g of a 30% non-volatile hydroxy functional aqueous acrylic microgel, 3.0 g butoxyethanol, 5.2 g SOLSPERSE® 20000, 2.0 g of 10% aqueous dimethylethanol amine solution and 1.5 g SURFYNOL® 104. The above components were mixed together, 72.0 g of TI-PURE® R-706 pigment were added and the resulting slurry was pre-dispersed using a Cowles blade. The mixture was then ground in a horizontal beadmill until the desired particle size of less than 0.5 micron was achieved.

Preparation of a Rheology Base:

A homogeneous blend was prepared by mixing together and stirring 47.5 g of a 30% non-volatile hydroxy functional aqueous acrylic microgel, 2.0 g of butoxyethanol and 0.5 g of SURFYNOL® 104. Following this, 50.0 g of 3% LAPONITE® RD in de-ionized water was added under stirring and homogenized and dispersed using a horizontal beadmill.

Preparation of a Waterborne Carbon Black Coating Composition:

A waterborne carbon black coating composition was prepared by mixing together the following constituents under constant agitation in the order stated: 26.8 pbw (parts by weight) of a 30% non-volatile hydroxyl-functional aqueous acrylic microgel, 16.2 pbw of carbon black pigment dispersion, 5.8 pbw of CYMEL® 303, 13.8 pbw of rheology base, 1.0 pbw of SURFYNOL® 104, and 2.0 pbw of butoxyethanol. The viscosity of the coating composition was adjusted to within the desired range of 2000-4000 mPa·s at shear rate D=1 $sec^{-1}$, and the pH was adjusted to within the desired range of 8.2-8.8 using 34.4 pbw of a combination of (i) de-ionized water, (ii) a 10% non-volatile pre-neutralized solution of ACRYSOL® ASE 60 in de-ionized water and (iii) a 10% aqueous dimethylethanol amine solution in de-ionized water.

Preparation of a Waterborne Perylene Black Coating Composition:

A waterborne perylene black coating composition was prepared by mixing together the following constituents under constant agitation in the order stated: 26.8 pbw of a 30% non-volatile hydroxy functional aqueous acrylic microgel, 16.2 pbw of perylene black pigment dispersion, 5.8 pbw of CYMEL® 303, 13.8 pbw of rheology base, 1.0 pbw of SURFYNOL® 104, and 2.0 pbw of butoxyethanol. The viscosity of the coating composition was adjusted to within the desired range of 2000-4000 mPa·s at shear rate D=1 $sec^{-1}$, and the pH was adjusted to within the desired range of 8.2-8.8 using 34.4 pbw of a combination of (i) de-ionized water, (ii) a 10% non-volatile pre-neutralized solution of ACRYSOL® ASE 60 in de-ionized water and (iii) a 10% aqueous dimethylethanol amine solution in de-ionized water.

Preparation of a Waterborne White Coating Composition:

A waterborne white coating composition was prepared by mixing together the following constituents under constant agitation in the order stated: 21.0 pbw of a 30% non-volatile hydroxy functional aqueous acrylic microgel, 2.0 pbw of STAPA® Hydrolan 9160, 4.2 pbw of CYMEL® 303, 21.0 pbw of titanium dioxide pigment dispersion, 0.2 pbw of perylene black pigment dispersion, 7.0 pbw of rheology base, 2.0 pbw of butoxyethanol, and 1.0 pbw of SURFYNOL® 104. The viscosity of the coating composition was adjusted to within the desired range of 2000-4000 mPa·s at shear rate D=1 $sec^{-1}$, and the pH was adjusted to within the desired range of 7.8-8.0 using 41.6 pbw of a combination of (i) de-ionized water, (ii) a 10% non-volatile pre-neutralized solution of ACRYSOL® ASE 60 in de-ionized water and (iii) a 10% aqueous dimethylethanol amine solution in de-ionized water.

Application of Waterborne Coating Compositions:

10.5 cm×30 cm, 1 mm thick steel test panels were processed and prepared with standard automotive pre-treatment, and dried and cured layers of grey electrocoat and midgrey primer.

Two 10.5 cm×30 cm transparent polyester films (Melinex® O from DuPont Teijin Films, film thickness 175 μm) were coated by spray-applying the waterborne black coating compositions onto their back face. The waterborne black coating compositions were spray-applied in 20 μm dry layer thickness and dried for 2 minutes at 20° C. Then the waterborne white coating compositions were spray-applied in 10 μm dry layer thickness and dried for 5 minutes at 70° C. The two-layer coated test films were then put in an oven and bake cured for 10 minutes at 140° C. (object temperature) to form multi-layer composites in the form of transparent polyester films with an uncoated front face and a back face having a cured two-layer coating. The multi-layer composites were applied onto the above mentioned coated test panels by adhesive bonding with the coated back face of the multi-layer composites turned to the midgrey primer layer of the steel test panels.

Testing was performed as follows:

A rectangular, open wooden box (dimensions inside 9.5 cm×29.4 cm, dimensions outside 12.6 cm×31.9 cm, height inside 5 cm and height outside 6.5 cm) was provided with a digital thermometer inside. To this end, the temperature sensor was fixed on a copper panel (8.5 cm×25.3 cm, thickness 1 mm) at the bottom inside the box. The box was closed by using one of the test panels as a lid with the uncoated front face of the polyester film turned outside (with the black color visible through the polyester film). Then the box was put on a table and illuminated from above with a halogen lamp (Osram, No. 64575, 1000 W) over 35 min (simulation of heating up in sunlight). The distance between the test panel surface and the light source was 35 cm and the temperature in the test room was 23° C. The temperature increase ΔT within the box was measured. Table 1 shows the results.

TABLE 1

| Two-layer coating on the back face of the transparent polyester film: | ΔT (° C.) |
|---|---|
| Carbon black coating + white coating (comparative example) | 44.1 |
| Perylene black coating + white coating (according to the invention) | 31.1 |

What is claimed is:

1. A process for the production of a multi-layer composite consisting of steps (1)-(3) as follows:

(1) applying a visually-opaque coating layer A' from a solvent-or water-borne pigmented coating composition A directly onto the back face of a transparent plastic film such that the coating layer A' is in direct physical contact with the transparent plastic film, wherein composition A comprises a pigment content and a resin solids content, wherein a ratio of pigment content to resin solids content is from 0.1:1 to 1:1, and wherein the overall solids content of composition A is from 10% to 40% by weight, and (2) applying an NIR-opaque coating layer B' from a solvent- or water-borne pigmented coating composition B directly onto the coating layer A' such that coating layer B' is in direct physical contact with the coating layer A' but not the transparent plastic film, wherein composition B is different than composition A, wherein composition B comprises a pigment content and a resin solids content, wherein a ratio of pigment content to resin solids content is either from 0.1:1 to 2:1 or from 0.05:1 to 50:1, wherein the overall solids content of composition B is from 2% to 40% by weight, wherein the pigment content of coating composition A consists of 50 to 100 wt. % of at least one black pigment with low NIR absorption and 0 to 50 wt. % of at least one further pigment, which is selected in such a way that coating layer A', in and of itself, exhibits low NIR absorption, and wherein the at least one black pigment with low NIR absorption is chosen from one or more of iron oxide black pigments, mixed metal/iron oxide black pigments, and perylene black pigments, wherein the pigment content of coating composition B is either a pigment content PC1 consisting of 90 to 100 wt. % of at least one aluminum flake pigment and 0 to 10 wt. % of at least one further pigment, which is selected in such a way that NIR-opaque coating layer B', in and of itself, exhibits low NIR absorption, or a pigment content PC2 comprising <90 wt. % of aluminum flake pigments and being composed in such a way that NIR-opaque coating layer B', in and of itself, exhibits low NIR absorption, and (3) curing coating layers A' and B', wherein the multi-layer composite produced by the method consisting of steps (1)-(3) exhibits a brightness L* of at most 10 units.

2. The process of claim 1, wherein coating composition A does not contain any carbon black.

3. The process of claim 1, wherein coating composition B has the pigment content PC1 and not the pigment content PC2.

4. The process of claim 1, wherein coating composition B has the pigment content PC2 and not the pigment content PC1.

5. The process of claim 4, wherein coating composition B is either (i) a solid color, white, or black coating composition free of special effect pigments, (ii) a coating composition comprising from 80 to 100 wt. % titanium dioxide, or (iii) a coating composition comprising less than 25 wt. % of aluminum flake pigments.

6. The process of claim 1, wherein coating composition B does not contain any carbon black.

7. The process of claim 1, wherein coating composition A is applied by roller coating.

8. The process of claim 1, wherein coating composition B is applied by roller coating.

* * * * *